US008526838B2

(12) United States Patent
Otaki

(10) Patent No.: US 8,526,838 B2
(45) Date of Patent: Sep. 3, 2013

(54) IMAGE FORMING APPARATUS IN WHICH A PRINT MODE OF A DOCUMENT IMAGE CAN BE ARBITRARILY SELECTED

(75) Inventor: Mitsuhiko Otaki, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 427 days.

(21) Appl. No.: 12/698,537

(22) Filed: Feb. 2, 2010

(65) Prior Publication Data

US 2010/0196041 A1 Aug. 5, 2010

Related U.S. Application Data

(60) Provisional application No. 61/150,244, filed on Feb. 5, 2009.

(51) Int. Cl.
*G03G 15/00* (2006.01)

(52) U.S. Cl.
USPC ..... 399/81; 399/86

(58) Field of Classification Search
USPC ..... 399/15, 16, 75, 81–87, 365, 367–374, 399/391, 392
See application file for complete search history.

(56) References Cited

U.S. PATENT DOCUMENTS

| | | | | |
|---|---|---|---|---|
| 5,689,759 | A | 11/1997 | Isemura et al. | |
| 2006/0245772 | A1* | 11/2006 | Akita et al. | 399/45 |
| 2008/0131145 | A1* | 6/2008 | Tao et al. | 399/21 |
| 2009/0279909 | A1* | 11/2009 | Matsushita et al. | 399/45 |

FOREIGN PATENT DOCUMENTS

| | | | |
|---|---|---|---|
| JP | 6-51597 | A | 2/1994 |
| JP | 6-167848 | A | 6/1994 |

* cited by examiner

*Primary Examiner* — Hoan Tran
(74) *Attorney, Agent, or Firm* — Patterson & Sheridan, LLP

(57) ABSTRACT

According to one embodiment, an image forming apparatus includes a document sensor to detect a width of a document stacked on an automatic document feeder (ADF), a sheet sensor to detect a width of a sheet stacked on a manual feed tray, memory to store, correspondingly to sheets of various sizes, print patterns based on which an entire area of a document image can be printed according to a document size, a controller which receives detection information from the sensors as input information, selects print patterns from the memory based on the input information, and displays the selected print patterns on a monitor, and a selector by which a user selects, from the print patterns displayed on the monitor, one pattern based on which a document image is printed on a sheet stacked on the ADF or the manual feed tray.

17 Claims, 4 Drawing Sheets

IMAGE FORMING APPARATUS IN WHICH A PRINT MODE OF A DOCUMENT IMAGE CAN BE ARBITRARILY SELECTED

CROSS-REFERENCE TO RELATED APPLICATION

This application is based upon and claims the benefit of priority from: U.S. provisional application 61/150,244, filed on Feb. 5, 2009, the entire contents of each of which are incorporated herein by reference.

TECHNICAL FIELD

The present invention relates to an image forming apparatus including an auto document feeder (ADF/RADF) to automatically feed documents one by one to an image reading section, and a manual feed tray to stack a sheet on which a document image is printed, and particularly to an image forming apparatus in which a print mode of a document image fed by an auto document feeder can be arbitrarily selected for the size of a sheet on a manual feed tray.

BACKGROUND

Hitherto, a copying machine as an image forming apparatus includes a printer section, an image reading section, and an auto document feeder to feed documents one by one to the image reading section. When a document is set on the auto document feeder, a document width detection sensor detects a document width as a length in a direction orthogonal to a document feed direction, and the document is sequentially read and is temporarily stored in a memory. The printer section includes one or plural paper feed cassettes to contain standard size sheets, and feeds a sheet in a selected paper feed cassette at a specified timing to an image forming section including, for example, a photoconductive drum and the like.

Besides, the copying machine includes a manual feed tray on which a user can arbitrarily stack a sheet irrespective of sheet size. When paper feed using the manual feed tray is selected, the sheet on the manual feed tray is fed to the image forming section. With respect to the sheets stacked on the paper feed cassette and the manual feed tray, the stack direction is determined on the assumption that the whole area of the document image of the same size is printed in equal magnification (first stack direction), or they are stacked in a direction (second stack direction) rotated by 90 degrees with respect to the first stack direction in order to perform reduced printing, enlarged printing or the like.

An image forming apparatus is proposed in which a manual feed tray is provided with a sheet width detection sensor to detect a sheet width as a length in a direction orthogonal to a conveyance direction of a stacked sheet, information of the sheet size is displayed on a display panel based on the sheet width of the sheet on the manual feed tray detected by the sheet width detection sensor, and the user selects the size of the sheet stacked on the manual feed tray from among plural sheet size candidates (JP-A-2006-018081).

For example, when the sheet width detection sensor detects a sheet width "a", there is a case where the long side length of an A4 size sheet is detected as "a", or the short side length of an A3 size sheet is detected as "a". Besides, when the sheet width detection sensor detects a sheet width "b", there is a case where the long side length of an A5 size sheet is detected as "b", or the short side length of an A4 size sheet is detected as "b". In such a case, selection is made as to the sheet size and as to whether the sheet stack direction is the first stack direction or the second stack direction.

As a result, in the related art image forming apparatus, duplex printing or printing with automatic variable magnification can be performed for the sheet stacked on the manual feed tray.

However, in the foregoing related art image forming apparatus, the use of the manual feed tray corresponds to only the standard image formation to print the whole area of the document image on the sheet in the same direction, and it can not be necessarily said that the function of the manual feed tray on which sheets of various sizes can be freely stacked is effectively used.

SUMMARY

The present invention has an object to provide an image forming apparatus in which image formation in different patterns is enabled for a sheet on a manual feed tray based on size information of a document image, and images of various print patterns can be formed using the manual feed tray.

In order to solve the problem, according to an aspect of the invention, an image forming apparatus includes an image reading section including an auto document feeding section to convey stacked documents one by one to a scanner section, an image forming section to form an image on a sheet conveyed to a printing section based on image information read by the image reading section, a manual feed tray section to stack sheets, a document width detection sensor to detect, as a document width, a length of a document stacked on the auto document feeding section in a direction orthogonal to a document conveyance direction, a sheet width detection sensor to detect, as a sheet width, a length of a sheet stacked on the manual feed tray in a direction orthogonal to a sheet conveyance direction, a print pattern memory to store, correspondingly to sheets of various sizes, print patterns in which the whole area of a document image can be printed according to a document size, a control section which receives sheet width detection information from the sheet width detection sensor and document width detection information from the document width detection sensor as input information, selects one or plural print patterns corresponding to the input information from the print pattern memory, displays the selected print patterns on a monitor, and displays document size patterns and print patterns for the sheet, and a print pattern selection section by which a user selects, from one or plural print pattern images displayed on the monitor, one pattern in which a document image is printed on the sheet stacked on the manual feed tray.

DETAILED DESCRIPTION

Hereinafter, an embodiment of the invention will be described in detail with reference to the drawings.

Figure 1:
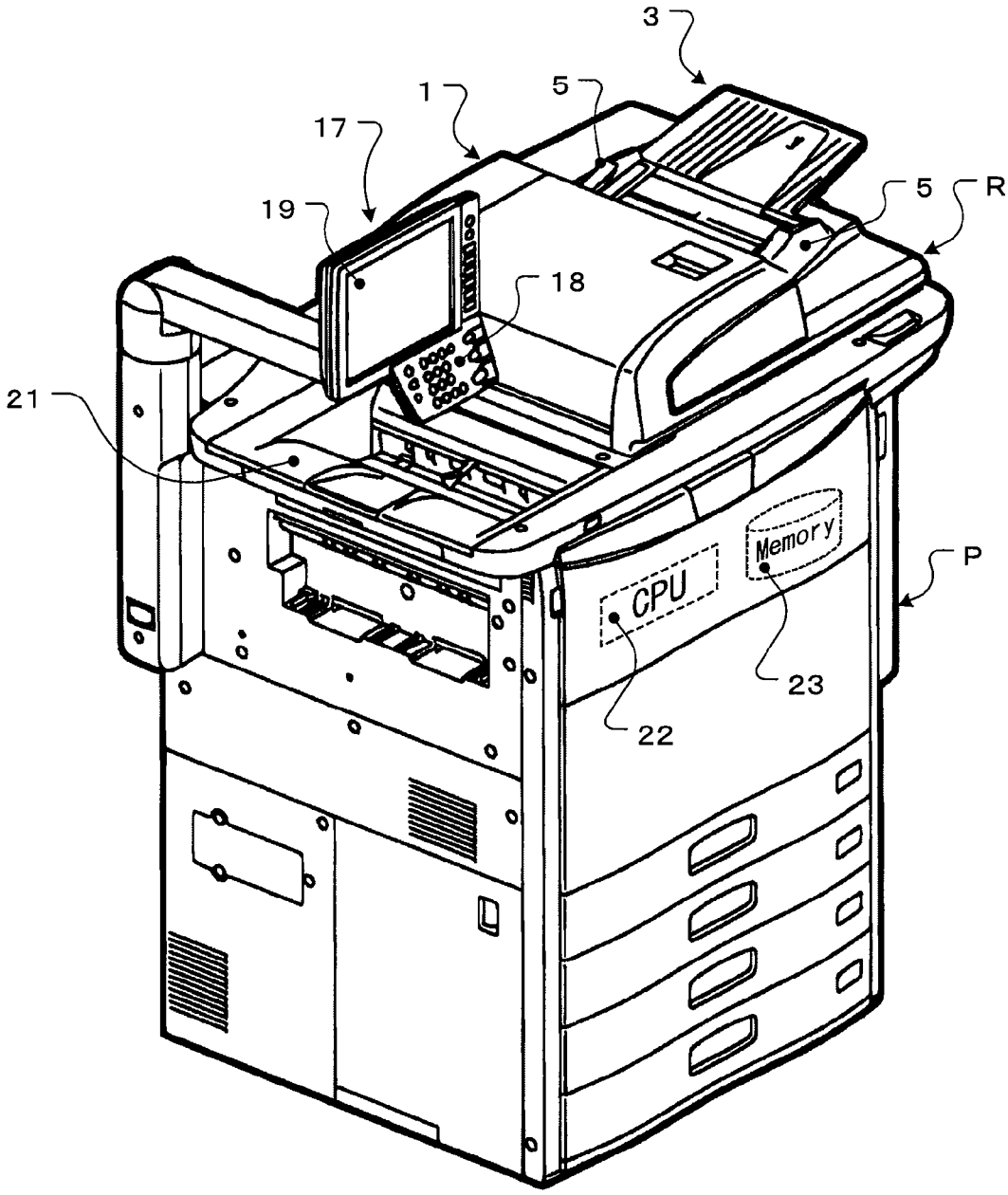
FIG. 1 is an outer appearance perspective view of an image forming apparatus of an embodiment of the invention.
Figure 2:
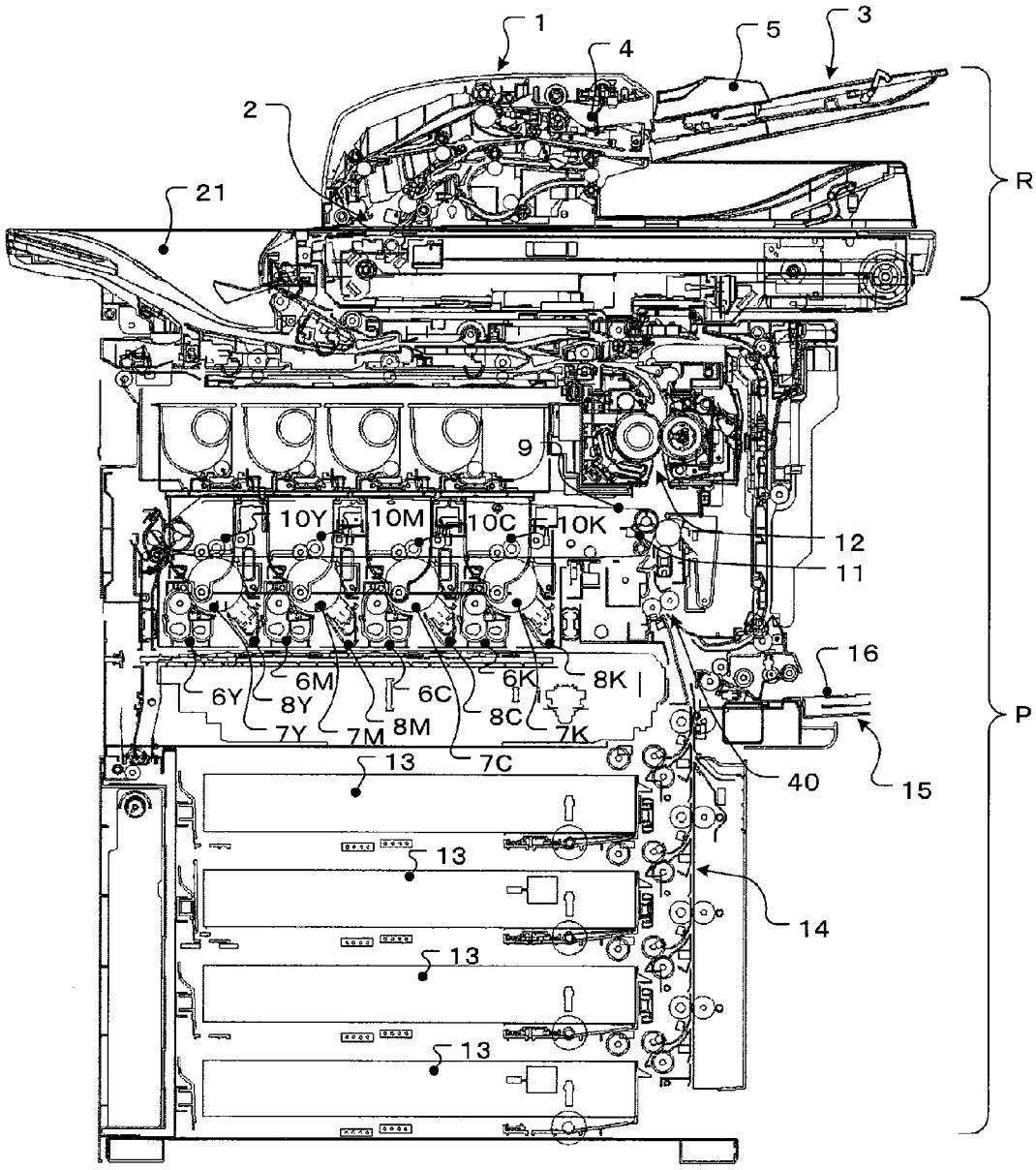
FIG. 2 is a longitudinal sectional view of the image forming apparatus shown in FIG. 1.

FIG. 1 is an outer appearance perspective view of an image forming apparatus of an embodiment of the invention, and FIG. 2 is a longitudinal sectional view of the image forming apparatus of FIG. 1.

As shown in FIG. 1, the image forming apparatus of the embodiment includes an image reading section R and an image forming section P, which are disposed up and down. The image reading section R includes an auto document feeder (ADF/RADF) 1, and has a function to scan and to read an image of a sheet document and a book document by a scanner section 2. The auto document feeder 1 includes a sheet document detection switch 4 to detect the presence or absence of a sheet document stacked on a sheet document stack tray 3, and a document width detection sensor to detect the sheet document stacked on the sheet document stack tray 3 in a document width direction as a direction orthogonal to a sheet document conveyance direction. The sheet document stack tray 3 is provided with a pair of document guide members 5 which are disposed to be opposite to each other in the width direction of the document and can be integrally moved in a direction of approaching each other and separating from each other along the document width direction. When a sheet document is stacked on the document stack tray 3, the document guide members 5 are adjusted to the width of the sheet document, so that the document width detection sensor detects the document width of the sheet document.

The image forming section P has a function to form a developer image (toner image) on a sheet-like sheet based on image information such as an image read from a document by the image reading section R or image data transmitted to the image forming apparatus from an external equipment. In the image forming section P, developing units (6Y, 6M, 6C, 6K) of respective colors of yellow (Y), magenta (M), cyan (C) and black (K), photoconductive drums (7Y, 7M, 7C, 7K) corresponding to the developing units of the respective colors, and toner image forming units (8Y, 8M, 8C, 8K) including a laser exposure device to expose the photoconductive drums of the respective colors with image lights based on image signals of the respective colors are arranged along an intermediate transfer belt 9.

Latent images formed on the photoconductive drums by the laser exposure device are developed by the developing units to obtain toner images. The toner images on the photoconductive drums of the respective colors are transferred to the outer peripheral surface of the intermediate transfer belt 9 by primary transfer rollers (10Y, 10M, 10C, 10K). The toner images on the intermediate transfer belt 9 in which the final black toner image is transferred and superimposed are transferred to the sheet-like sheet by a secondary transfer roller 11 at a secondary transfer position. Then, when the sheet to which the non-fixed toner images are transferred passes through a nip part of a fixing unit 12 including a heat roller and a pressure roller, the non-fixed toner images are melted by heat and pressure and are fixed to the sheet.

The sheets are contained in plural paper feed cassettes 13 disposed in the up-and-down direction, and the sheet in the paper feed cassette 13 is conveyed through a sheet conveyance path 14 extending in the up-and-down direction via the secondary transfer position to the fixing unit 12.

On the other hand, a manual feed tray 15 is disposed at the outside of the side wall section close to the sheet conveyance path 14 of the printer section P. The manual feed tray 15 is provided with a sheet width detection sensor to detect the width of a sheet in a direction orthogonal to a conveyance direction of a sheet stacked on the tray. The manual feed tray 15 is provided with a pair of sheet guide members 16 which are disposed to be opposite to each other in the width direction of the sheet and are integrally movable in the direction of approaching each other and separating from each other along the sheet width direction. When the sheet is stacked on the manual feed tray 15, the sheet guide members 16 are adjusted to the width of the sheet, so that the sheet width detection sensor detects the width of the sheet.

When the sheet on the manual feed tray 15 is selected and copying is performed, when a print button of an operation switch section 18 arranged on an operation panel 17 shown in FIG. 1 is depressed, image formation is started in a print pattern selected through an after-mentioned monitor 19 with touch switch. The sheet on the manual feed tray 15 is conveyed to a register roller 20, and an image is transferred to the sheet by the secondary transfer roller 11 at the secondary transfer position and at a specified timing, and the sheet is discharged to a storage tray 21 through the fixing unit 12.

The print patter is stored in a memory 23, and is formed such that a CPU 22 to control the whole operation of the image forming apparatus controls the image forming operation. The image formation in accordance with the print pattern is performed using the enlargement, reduction and rotation functions of the image and is performed except for equal magnification printing.

For example, there are exemplified a standard print mode between standard sizes in which the whole area of a document image of a size (for example, A4 size) different from a size (for example, A3 size) of a sheet is printed on the sheet or is printed on a half area of the sheet, and a special print mode in which a document image of a standard size is printed on a sheet of a non-standard size, or printing can be made at an arbitrary position of a sheet by setting of a margin position or the like.

The CPU 22 reads plural sheet-like documents by the scanner section 2 through the auto document feeder 1 and can execute the print mode as stated above for the read data stored in the memory 23.

Figure 3:
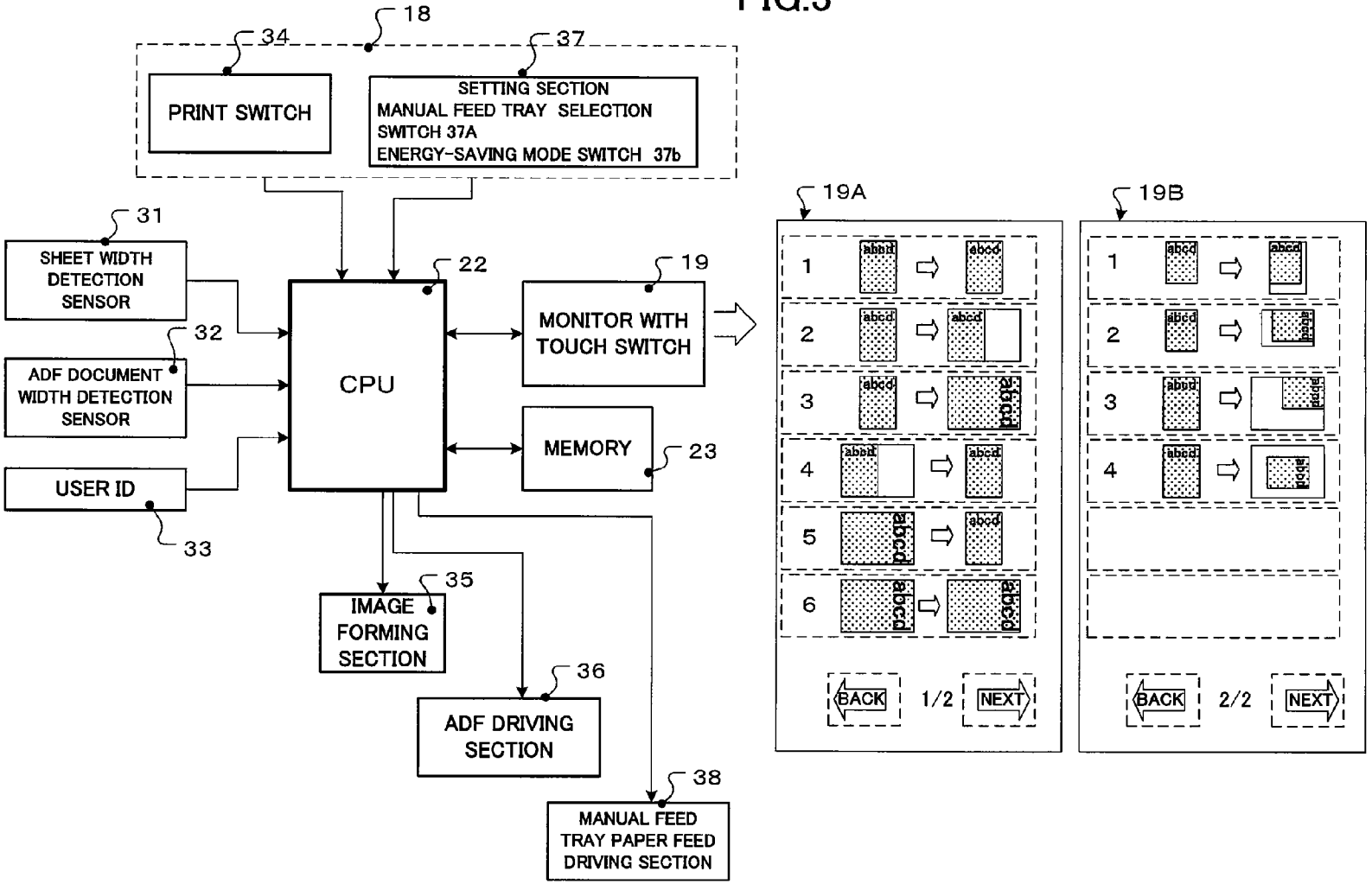
FIG. 3 is a control block diagram of image formation to a sheet using a manual feed tray of the image forming apparatus shown in FIG. 1 and FIG. 2.
Figure 4:
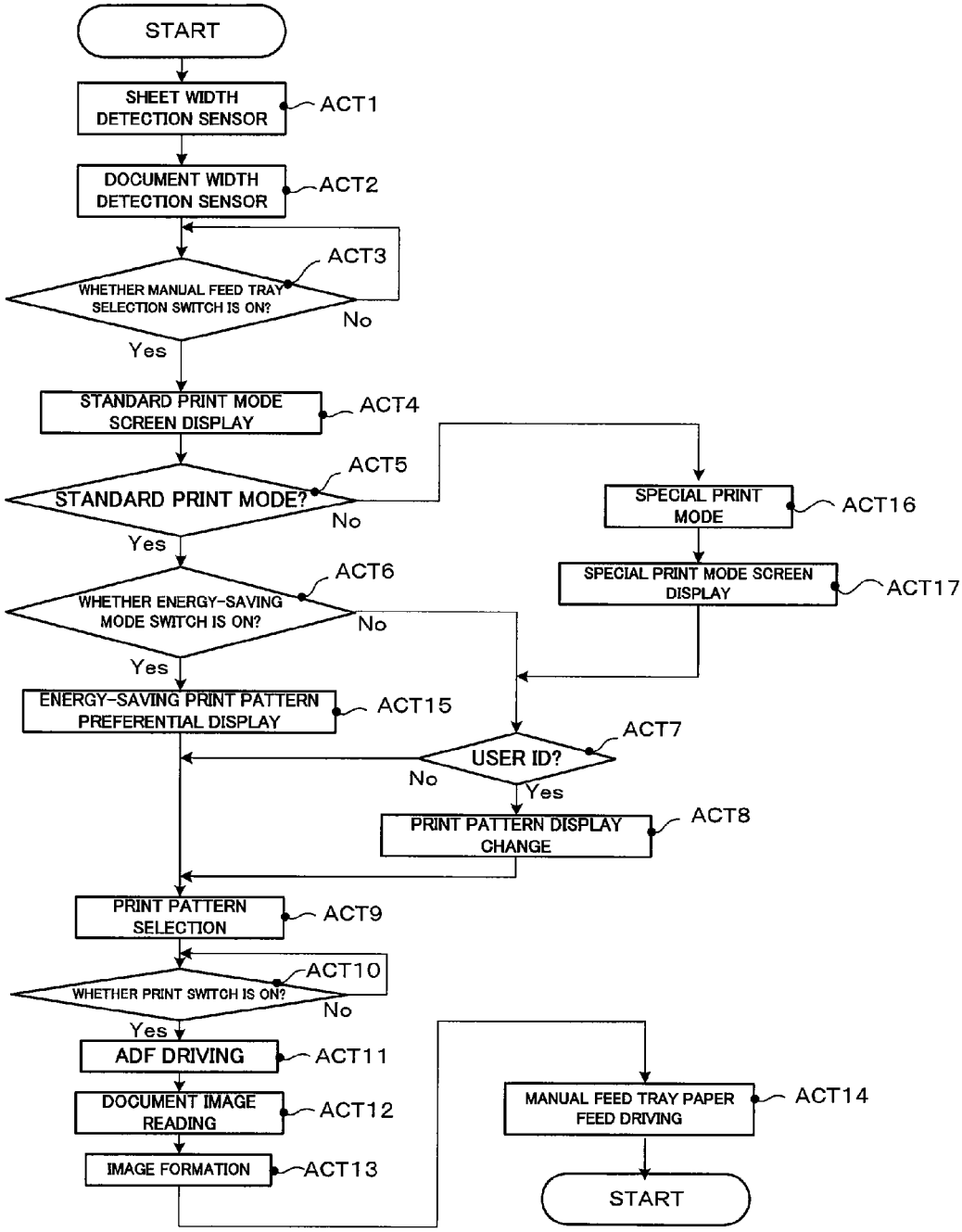
FIG. 4 is a flowchart for explaining an operation of a control block shown in FIG. 3.

FIG. 3 is a control block diagram of image formation to a sheet using the manual feed tray of the image forming apparatus shown in FIG. 1 and FIG. 2, and FIG. 4 is a flowchart for explaining the operation of a control block shown in FIG. 3.

In FIG. 3, a detection signal of the sheet width detection sensor 31 provided on the manual feed tray 15 and detection information of the document width detection sensor 32 provided on the auto document feeder (ADF/RADF) 1 are inputted to the CPU 22. The memory 23 stores data of the standard print mode and the special print mode. When a manual feed tray selection switch 37*a* which is provided on a setting section 37 of the operation switch section 18 and selects paper feeding using the manual feed tray is turned ON, a standard print mode screen denoted by 19A or a special print mode screen denoted by 19B is displayed on the monitor 19 with touch screen.

When the sheet size based on the sheet width detected by the sheet width detection sensor 31 is standard, and the document size based on the document width detected by the document width detection sensor 32 is standard and has the same series as the sheet size, for example, when both the sheet size and the document size are A series (standard series), and when they are the same in size or different in size, the CPU 22 reads the standard print mode from the memory 23, and displays the standard print mode screen 19A on the monitor 19 with touch switch.

Besides, when the series based on the sheet width detected by the sheet width detection sensor 31 and the series based on the document width detected by the document width detection sensor 32 are standard but are different from each other, for example, when the sheet size is the B series and the document size is the A series, or the sheet is non-standard size, the special print mode is read from the memory 23, and the special print mode screen 19B is displayed on the monitor 19 with touch switch.

Besides, the standard print mode screen 19A and the special print mode screen 19B can be arbitrarily changed by depressing the "NEXT", "BACK" display section at the lower part of the screen.

The standard print mode screen 19A displays sheets of specifiable standard sizes at the right side based on the sheet width information detected by the sheet width detection sensor 31, and displays document patterns at the left side based on the document width information detected by the document width detection sensor 32. That is, when the document width detection sensor 32 detects the document width "a", and when this length "a" is the length of the long side of an A4 size document or the short side of an A3 size document in the standard size, A4 size document patterns are displayed correspondingly to pattern numbers 1, 2 and 3 displayed at the left end, and A3 size document patterns are displayed correspondingly to pattern numbers 4, 5 and 6. Besides, A4 size sheet patterns are displayed at the right end correspondingly to the pattern numbers 1, 4 and 5, and A3 size sheet patterns are displayed correspondingly to the pattern numbers 2, 3 and 6.

An area indicated by a broken line surrounding a document pattern and a sheet pattern as well as each pattern number on the monitor 19 with touch switch is a touch switch, and when the user depresses a touch switch of a desired print pattern, the CPU 22 instructs the image forming section 35 and a manual feed tray paper feed driving section 38 to perform the image formation in the selected print pattern.

Incidentally, in a state where plural documents are set on the auto document feeder 1, the CPU 22 reads the standard print mode or the special print mode from the memory 23 based on the document width information detected by the document width detection sensor 32.

On the standard print mode screen 19A, the pattern number 1 indicates a pattern in which for example, the whole area of an A4 size document image is printed on an A4 size sheet in equal magnification, the pattern number 2 indicates a pattern in which for example, an A4 size document image is printed on one side of an A3 size sheet in equal magnification, and the pattern number 3 indicates a pattern in which for example, an A4 size document image is enlarged and is printed on the whole area of an A3 size sheet.

Besides, the pattern number 4 indicates a pattern in which for example, an image area exists only at one side of an A3 size document image and the image is printed on an A4 size sheet in equal magnification, the pattern number 5 indicates a pattern in which for example, an A3 size document image is reduced and is printed on the whole area of an A4 size sheet, and the pattern number 6 indicates a pattern in which for example, an A3 size document image is printed on the whole area of an A3 size sheet in equal magnification. Incidentally, these patterns are merely examples, and printing between an A4 size document image and an A5 size sheet, or printing between an A5 size document image and an A3 size sheet may be performed.

Besides, the order of the print patterns indicated by the pattern numbers 1, 2, 3, 4, 5 and 6 may be changed according to the use frequency or the like. Besides, by inputting an user ID 33 to the CPU 22, the print patterns may be displayed in accordance with the use frequency of each user or previously registered priority.

In the pattern numbers 4 and 5, since the document image is printed on the sheet of the size smaller than the size of the document image, when an energy-saving switch 37*b* provided in the setting section 37 of the operation switch section 18 is turned ON, the priority of the print patterns of the pattern numbers 4 and 5 is changed to No. 1 and No. 2, and printing in automatic reduction is performed by selecting one of them.

Next, the special print mode screen 19B displays document image patterns at the left side of the screen and shows a case where the sizes of all the document image patterns in pattern numbers 1, 2, 3 and 4 are, for example, A4 size. As stated above, the patterns of the document images are specified to, for example, the A4 size by only the detection width information of the document width detection sensor 32, and is automatically specified when the user designates the use of the A4 document by, for example, the setting section 37, or the user specified by the user ID uses the A4 document. Of course, in the special print mode, similarly to the standard print mode, the document size may be set based on the detection information of the document width detection sensor 32.

On the special print mode screen 19B, with respect to the sheet patterns displayed at the right end, pattern numbers 1 and 2 indicate the case where the sheets are non-standard sheets different from the document size, and the stacking directions of the sheets on the manual feed tray are different. The pattern number 1 indicates the state where the document width in the direction orthogonal to the conveyance direction of the sheet is longer than that of the pattern number 2.

Besides, on the special print mode screen 19B, the pattern number 3 indicates a pattern in which when the size of the sheet is larger than the size of the document image and the sheet width is equal to the document width, the document image is printed on the corner of the sheet in equal magnification, and the pattern number 4 indicates a pattern in which although the relation between the document size and the sheet size is the same as that of the pattern number 3, the document image is printed on the center part of the sheet in equal magnification. These print patterns are selected by depressing the touch switch of the pattern selected by the user, and the CPU 22 instructs the image forming section 35 and the manual feed tray paper feed driving section 37 to perform image formation in the selected print pattern.

Incidentally, although the A series is exemplified for both the document size and the sheet size, it is needless to say that a letter size and a legal size may be used.

As stated above, when the print pattern in the standard print mode and the special print mode is determined, and a print switch 34 is turned ON, plural documents stacked on the auto document feeder 1 are fed one by one, and the document image is read by the scanner 2 and is stored in the memory 23. When reading of all the documents is ended, image formation is started based on the document image information stored in the memory 23. The sheet on the manual feed tray 15 is conveyed one by one to the secondary transfer position, the document image is transferred to the sheet in the print pattern determined in the standard print mode or the special print mode, and the sheet on which the document image is fixed by the fixing unit 12 is discharged to the storage tray 21. Incidentally, in the case of duplex printing, the sheet is conveyed from the storage tray 21 to a register roller 40 through a duplex reversing conveyance path, the document image is formed on the back side at the secondary transfer position, and the sheet passes through the fixing unit 12 and is discharged to the storage tray 21.

The operation of the control block diagram shown in FIG. 3 will be described on the basis of the flowchart shown in FIG. 4.

When the user stacks sheets of the print size to be desired on the manual feed tray 15 or uses sheets already, stacked on the manual feed tray 15 and prints, the sheet width detection sensor 31 detects the sheet width of the sheet on the manual feed tray 15 (ACT 1), and the document width detection sensor 32 detects the document width (ACT 2).

When the user turns ON the manual feed tray selection switch 37*a* of the setting section 37 in order to print the image of the document stacked on the auto document feeder 1 by using the sheet stacked on the manual feed tray 15 (ACT 3), the standard print mode screen is displayed on the monitor 19 with touch switch (ACT 4).

At ACT 5, when the user desires printing in the standard print mode, advance is made to ACT 6 while the display of the standard print mode screen is kept. When the user depresses the "NEXT" touch switch of the monitor 19 with touch switch in order to select printing in the special print mode as the mode other than the standard print mode, advance is made to ACT 16 and the special print mode is selected. Then, the special print mode screen 19B is displayed (ACT 17), and advance is made to ACT 7.

At ACT 6, it is determined whether a mode is an energy-saving mode, and when the energy-saving mode switch 37*b* is not turned ON, advance is made to ACT 7.

At ACT 7, it is determined whether the user ID 33 is inputted. When the user ID is inputted, the print patterns registered by the user are displayed, or the print pattern display is changed in the priority according to the user's use frequency, and advance is made to ACT 9.

At ACT 9, the user depresses the touch switch of the pattern to be printed among the print modes displayed on the monitor 19 with touch switch, and selects the print pattern, and advance is made to ACT 10.

At ACT 10, when the print switch 34 is turned ON, auto document feeding is started by driving of the auto document feeder (ACT 11), and the scanner section 2 reads the document image (ACT 12). Incidentally, when the document is fed to the scanner section 2, or when the document image is read, the length of the document in the feed direction is also detected, and the size of the document is detected. The read document image is temporarily stored in the memory 23, and when reading of all document images is ended, the image formation process is executed in accordance with the print mode (ACT 13), paper feed driving of the manual feed tray 15 is performed (ACT 14), and the document image is formed on the sheet in the selected pattern.

When it is determined at ACT 6 that the energy-saving mode switch 37*b* is ON, the energy-saving print patterns are preferentially displayed on the standard print mode screen display (ACT 15), and advance is made to ACT 9. The document image is formed on the sheet in the print pattern selected from the print patterns in the priority mode (ACT 10 to ACT 14).

As stated above, according to the embodiment, when the image of the document stacked on the auto document feeder 1 is printed on the sheet stacked on the manual feed tray 15, unless a print pattern in which the size of the document is larger than the sheet size is set, it is possible to prevent occurrence of misprint that a part of the document image protrudes from the sheet and is printed. Besides, various size sheets are used by the selection of the user, and the document image can be printed in various modes. The document image can be formed in various patterns by using the manual feed tray.

The present invention can be carried out in various modes without departing from the sprit or the gist thereof. Accordingly, the foregoing embodiment is merely an example in every point, and should not be interpreted restrictedly. The scope of the present invention is defined by the claims and is not restricted by the present specification. Further, all modifications, various improvements, substitutions and alterations belonging to the equivalent scope of the claims are within the scope of the present invention.

What is claimed is:

1. An image forming apparatus comprising:

an image reading section including an auto document feeding section to convey stacked documents one by one to a scanner section;

an image forming section to form an image on a sheet conveyed to a printing section based on image information read by the image reading section;

a manual feed tray section to stack sheets;

a document width detection sensor to detect, as a document width, a length of a document stacked on the auto document feeding section in a direction orthogonal to a document conveyance direction;

a sheet width detection sensor to detect, as a sheet width, a length of a sheet stacked on the manual feed tray in a direction orthogonal to a sheet conveyance direction;

a print pattern memory to store, correspondingly to sheets of various sizes, print patterns each showing the whole area of a document image printed on a sheet having one of the various sizes;

a control section which receives, as input information, sheet width detection information from the sheet width detection sensor and document width detection information from the document width detection sensor, selects one or a plurality of the print patterns based on the input information from the print pattern memory, displays combinations of the selected print patterns and a document size pattern on a monitor; and a print pattern selection section by which a user selects one of the combinations displayed on the monitor, according to which the document image is printed on the sheet stacked on the manual feed tray.

2. The apparatus of claim 1, wherein the print pattern memory stores print patterns showing the document size and the sheet size equal to each other, the document size smaller than the sheet size in a corresponding relation, and the document image printed on the sheet in equal magnification.

3. The apparatus of claim 1, wherein the print pattern memory stores print patterns showing the document size and the sheet size equal to each other, the document size smaller than the sheet size in a corresponding relation, and the document image printed on one side of the sheet in equal magnification.

4. The apparatus of claim 1, wherein the print pattern memory stores print patterns showing the document size and the sheet size equal to each other, the document size smaller than the sheet size in a corresponding relation, and the document image enlarged and printed on the sheet.

5. The apparatus of claim 1, wherein the print pattern memory stores print patterns showing the document size and the sheet size equal to each other, the document size larger than the sheet size in a corresponding relation, and the whole area of the document image formed on only one side of the document printed on the sheet.

6. The apparatus of claim 1, wherein the print pattern memory stores print patterns showing the document size and the sheet size equal to each other, the document size larger than the sheet size in a corresponding relation, and the document image reduced and printed on the sheet.

7. The apparatus of claim 1, wherein the print pattern memory stores print patterns showing the document size equal to the sheet size in a corresponding relation, and the document image printed on the sheet in equal magnification.

8. The apparatus of claim 1, wherein the print pattern memory stores print patterns showing the document size and the sheet size different from each other, the document size smaller than the sheet size in a corresponding relation, and the document image printed on the sheet in equal magnification.

9. The apparatus of claim 1, wherein the print pattern memory stores print patterns showing the document size smaller than the sheet size in a corresponding relation, and the document image printed on a center of the sheet in equal magnification.

10. The apparatus of claim 1, wherein an energy-saving mode is provided, and when the energy-saving mode is selected, the control section preferentially displays a print pattern having a reduced document image on the monitor.

11. The apparatus of claim 1, wherein the control section changes a display order of the combinations displayed on the monitor according to a use frequency of the print patterns.

12. The apparatus of claim 1, wherein the print pattern memory stores print patterns for respective users, and when a user is specified and manual feed printing is performed, the control section includes print patterns for the user in the combinations displayed on the monitor.

13. An image forming apparatus comprising:

an image reading section including an auto document feeding section to convey stacked documents one by one to a scanner section;

an image forming section to form an image on a sheet conveyed to a printing section based on image information read by the image reading section;

a sheet feeding section to stack sheets;

a document size detection sensor to detect a size of a document stacked on the auto document feeding section;

a sheet width detection sensor to detect, as a sheet width, a length of a sheet stacked on the sheet feeding section in a direction orthogonal to a sheet conveyance direction;

a print pattern memory to store, correspondingly to sheets of various sizes, print patterns each showing the whole area of a document image printed on a sheet having one of the various sizes;

a control section which receives, as input information, sheet width detection information from the sheet width detection sensor and document size information from the document size sensor, selects one or a plurality of the print patterns based on the input information from the print pattern memory, displays combinations of the selected print patterns and a document size pattern on a monitor; and a print pattern selection section by which a user selects one of the combinations displayed on the monitor, according to which the document image is printed on the sheet stacked on the sheet feeding tray.

14. The apparatus of claim 13, wherein the sheet feeding section stacks sheets on a tray.

15. The apparatus of claim 13, wherein the sheet feeding section stacks non- standard sheets.

16. The apparatus of claim 13, wherein the control section has a mode of operation, in which mode the control section changes a display order of the combinations displayed on the monitor.

17. The apparatus of claim 16, wherein the mode is an energy-saving mode.

* * * * *